US011696640B2

(12) United States Patent
Mølgaard et al.

(10) Patent No.: US 11,696,640 B2
(45) Date of Patent: Jul. 11, 2023

(54) SHELVING SYSTEM

(71) Applicant: LEGO A/S, Billund (DK)

(72) Inventors: Rikke Høgstrup Mølgaard, Billund (DK); Søren Hansen Hinge, Billund (DK); Søren Holm, Billund (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 16/637,222

(22) PCT Filed: Aug. 16, 2018

(86) PCT No.: PCT/EP2018/072225
§ 371 (c)(1),
(2) Date: Feb. 6, 2020

(87) PCT Pub. No.: WO2019/034734
PCT Pub. Date: Feb. 21, 2019

(65) Prior Publication Data

US 2020/0229594 A1 Jul. 23, 2020

(30) Foreign Application Priority Data

Aug. 18, 2017 (DK) ..... PA 2017 70628

(51) Int. Cl.
*A47B 47/00* (2006.01)
*A47B 47/04* (2006.01)
(Continued)

(52) U.S. Cl.
CPC ..... *A47B 47/0091* (2013.01); *A47B 47/047* (2013.01); *A47B 57/34* (2013.01); *A47B 57/485* (2013.01)

(58) Field of Classification Search
CPC ... A47B 47/0091; A47B 47/047; A47B 57/34; A47B 57/485; A47B 57/487;
(Continued)

(56) References Cited

U.S. PATENT DOCUMENTS 5,779,515 A * 7/1998 Chung ..... A63H 33/04 446/102
D409,690 S * 5/1999 Nielsen ..... D21/564
(Continued)

FOREIGN PATENT DOCUMENTS

DE 3047698 A1 7/1982
WO 1996018329 A1 6/1996
(Continued)

OTHER PUBLICATIONS

Upcoming, "Brik Tile | Lego(TM) Compatible Wall Tiles," Jul. 2, 2016, YouTube, URL: https://www.youtube.com/watch?v=HMRCSrb3Lqk, 2 pages, [retrieved on Feb. 23, 2021].
(Continued)

*Primary Examiner* — Devin K Barnett
(74) *Attorney, Agent, or Firm* — Day Pitney LLP; Anthony A. Kassas

(57) ABSTRACT

A shelving system comprising at least one back panel and at least one block element, the back panel comprises a substantially planar surface, and where the at least one block element is mounted on the back panel, wherein the back panel comprises at least two areas, a first area of the at least one back panel comprising protrusions; the protrusions being mutually identical and positioned on the planar surface in grid points of a regular two dimensional grid; and a second area of the at least one back panel comprises the at least one block element, the block element extending in a distance corresponding to one or multiple of a standard module size in a plane parallel to the planar surface of the back panel in two mutually perpendicular directions defined by grid points of a regular two dimensional grid.

19 Claims, 7 Drawing Sheets

(51) Int. Cl.
*A47B 57/34* (2006.01)
*A47B 57/48* (2006.01)

(58) Field of Classification Search
CPC ..... A47B 57/06; A47B 57/16; A47B 57/20; A47B 57/22; A47B 57/30; A47B 47/021; A47B 47/022; A47B 57/40; A47B 57/42; A47B 57/48; A47F 5/08; A47F 5/0807; A47F 5/0815; A47F 5/0823; A47F 5/083; A47F 5/0838
See application file for complete search history.

(56) References Cited

U.S. PATENT DOCUMENTS 6,443,796 B1 * 9/2002 Shackelford ..... A63H 33/042 273/237
6,616,500 B1 * 9/2003 Harms ..... A63H 18/02 446/128
6,996,945 B2 * 2/2006 Doty ..... E04B 2/18 52/582.1
2014/0251933 A1 9/2014 Old et al.
2017/0225090 A1 8/2017 Dripps et al.

FOREIGN PATENT DOCUMENTS

WO 1997038610 A1 10/1997
WO 2016106124 A1 6/2016

OTHER PUBLICATIONS

Communication pursuant to Article 94(3) issued in corresponding European patent application 18755473.8-1005 dated Mar. 1, 2021, 6 pages.
First Technical Examination Report issued in Danish priority application No. PA 2017 70628, dated Feb. 20, 2018. (8 pp).
International Search Report and Written Opinion of the International Searching Authority issued in corresponding International application No. PCT/EP2018/072225, dated Oct. 29, 2018. (8 pp).

* cited by examiner

SHELVING SYSTEM

CROSS-REFERENCE TO RELATED APPLICATIONS

This application is a U.S. National Stage of International Application No. PCT/EP2018/072225, filed on 16 Aug. 2018 and published on 21 Feb. 2019, as WO 2019/034734 A1, which claims the benefit of priority to Danish Patent Application No. DK PA201770628, filed on 18 Aug. 2017. The content of each of the above referenced patent applications is incorporated herein by reference in its entirety for any purpose whatsoever.

The present invention relates to a shelving system comprising at least one back panel and at least one block element, the back panel comprises a substantially planar surface, and where the at least one block element is mounted on the back panel. The shelving system according to the invention may also be referred to as a shelf system.

DESCRIPTION OF RELATED ART

It is known to have building systems that consist of stackable building elements, such as LEGO elements or EverBlocks.

It is also known to assemble building elements on a vertically oriented building plate to achieve three-dimensional effects, such as a three-dimensional image.

A toy building plate may be mounted on a wall surface and then building elements may be mounted on the building plate and on top of each other, respectively. The toy building elements extend horizontally in varying distance from the toy building plate and the wall.

However, it can be difficult to build horizontally, as the coupling organs of the building elements may lack clapping effect to withhold the weight of the building elements themselves. Previously, this problem has been solved by gluing the toy building elements together.

It would be desirable to provide a shelving system being strong enough to hold the weight of displayed items.

SUMMARY OF THE INVENTION

It is therefore an object of the invention to provide a sturdy and strong shelving system.

This is solved in part according to the features listed in the characterizing part of claim 1.

Hereby is achieved a strong shelving system that gives the illusion that it has been constructed by standardized modular units, such as toy construction elements. Preferably, the second area has no protrusions it is free from protrusions.

In an embodiment, the first standard module size may be defined by the distance between grid points of a two dimensional grid.

Further advantageous features are provided in the dependent claims.

In an embodiment, the one or more block elements extend perpendicular to the planar surface of the back panels in a distance corresponding to a multiple of one or multiple of a second standard module size. In an embodiment, the second standard module size may be defined by the distance between grid points of a three dimensional grid.

In an embodiment, the outer surface of the block elements extends in one or more standard module sizes in three mutually perpendicular directions.

In an embodiment, the size of the block element in the plane parallel to the planar surface of the back panel in the two mutually perpendicular directions defined by grid points of the regular two dimensional grid correspond to the size of the second area.

In an embodiment, the protrusions comprise a cylindrical shape adapted to simulating coupling organs of a toy construction system.

In an embodiment, the outer surface of the block element comprises a cladding, which is formed in a plastic, such as Kerrock or Corion.

In an embodiment, the cladding comprises one or more indentations, the indentations adapted to divide the block element visually into modular parts in all three mutually perpendicular directions, such that each modular part is fully or partly outlined by indentations in a direction perpendicular to the planar surface and in a direction parallel to the planar surface, the indentations are interposed intermediate the grid points of the regular grids.

In an embodiment, the shelving system comprises one or more block bases and the one or more block elements comprises a cavity, the cavity comprises a shape complementary to the outer surface of the one or more block bases allowing the one or more block elements to be mounted on and enclosing the one or more block bases.

In an embodiment, the block element comprises protrusions positioned in grid points of the regular grid, the protrusions comprise a cylindrical shape extending in a direction perpendicular to the planar surface of the back panel, thus simulating coupling organs of a toy construction system.

In an embodiment, the block element comprises one or more top panels, the top panels extend in a distance of ⅓ of a standard module in the direction perpendicular to the planar surface, the top panels are marked by the one or more indentations of a second type, the one or more indentations of a second type extend parallel with the planar surface in a distance from the planar surface corresponding to one or more standard module sizes, thus simulating a cover panel of toy construction system.

In an embodiment, all surfaces of the back panels and the one or more block elements extending parallel with the planar surface, within the at least first and second areas, comprise either a cylinder shaped protrusion or a top panel, such that all grid points of the regular grid within the at least two areas comprise a cylinder shaped protrusion or a top panel.

In an embodiment, the block element comprises a support structure, the support structure defines the inner cavity, which is shaped complementary to the outer surface of the block base.

In an embodiment, the one or more back panels comprise a base structure, the base structure is covered by an inner cladding adapted for strengthening the one or more back panels to avoid bending of the one or more back panels.

In an embodiment, the grid points are positioned on grid points of a regular cubical three-dimensional grid, the cubical standard module comprises the sizes of 150 mm, 150 mm and 180 mm respectively.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

It is to be noted that the figures and the above description have shown the example embodiments in a simple and schematic manner. The internal electronic and mechanical details have not been shown since the person skilled in the art should be familiar with these details and they would just unnecessarily complicate this description.

FIGS. 1-8 show different views of one embodiment of a shelving system according to the present invention.

The term grid point is meant as points which are positioned on grid points of a regular grid. The grid points will be arranged in a pattern such that their relative positions and distances from each other follow a set of geometrical constraints.

The regular grid may be a two-dimensional grid or a three-dimensional grid, e.g a square grid, a cubic grid, a rectangular grid or the like.

The term first standard module size is meant as the distance between two adjacent grid points, and thus a standard module having the size of the distance between two adjacent grid points of a regular grid.

The term "a modular part" is meant as a three dimensional part comprising the sizes of one or multiple of a standard module size in at least two of the three directions in a three dimensional grid. In the third direction a "modular part" may have a second standard module size, which is in the same order as the first standard module size. In one embodiment the first and second standard module sizes are equivalent. However, in other embodiments the first and second standard module sizes may be different.

Figure 1:
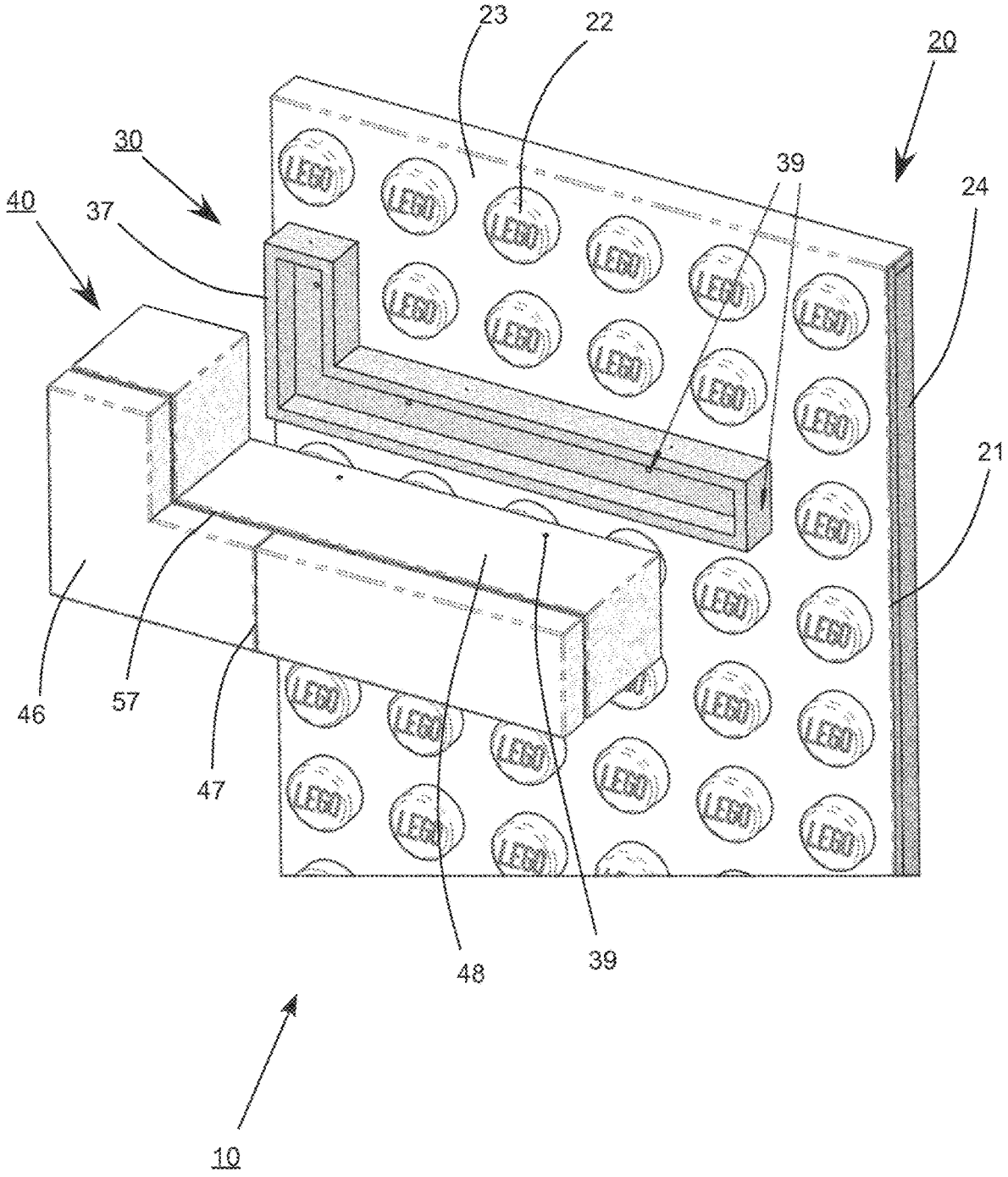
FIG. 1 shows a three dimensional view of a shelving system.

FIG. 1 shows a three dimensional view of a shelving system 10 (or shelf system 10). The shelving system 10 may be adapted to provide display shelving or/and display areas.

The shelving system comprises a back panel 20, a block base 30 and a block element 40.

The back panel 20 comprises a base structure 24, which is covered by a cladding 21. The back panel comprises a first area comprising a substantially outer planar surface 23 and protrusions 22. The protrusions 22 are formed in a cylindrical shape. The protrusions 22 could also be referred to as knobs.

The protrusions 22 are positioned on the planar surface 23 in grid points of a regular two dimensional grid. The grid points are arranged in a two dimensional square grid pattern parallel to the planar surface 23. The first standard module size is defined as the distance between two adjacent grid points, and thus a standard module has the size (in the plane of the planar surface 23) of the distance between two adjacent grid points of the regular grid.

In the shown embodiment, in FIG. 1, the back panel comprises a second area equivalent to six grid points, where six protrusions 22 are replaced by a block base 30. The block base 30 is mounted on the back panel 20 by fastening means 39, such as screws.

The block base 30 comprises a protruding flange 37, which extends perpendicular from the planar surface 23 of the back panel 20.

The block element 40 is shaped complementary to the outer surface of the block base 30. The block element 40 is mounted on and enclosing the block base 30 and fixed to the back panel or the block base 30 by fastening means 39, such as screws.

The block element 40 in this embodiment comprises a first modular element 48 and a top panel 46.

The block element 40 extends, in a plane parallel to the planar surface 23 of the back panel 20, a distance corresponding to five standard modules sizes in one, first direction, i.e. a whole number (multiple) of grid points, and in one and two first standard module sizes in a second direction perpendicular to the first direction (and in a plane parallel to the planar surface 23), and in such a way that each grid point in the regular two-dimensional grid is covered by a protrusion 22 or a block element 40.

The first modular element 48 thus also extends, in the plane parallel to the planar surface 23 of the back panel 20, a distance corresponding to five first standard modules in one, first direction, and in one and two standard module sizes in a second direction perpendicular to the first direction (and in a plane parallel to the planar surface 23).

The first modular element 48, in a direction perpendicular to the planar surface 23 of the back panel 20, extends a distance of one second standard module size.

The block element 40 comprises an outer surface which comprises indentations 47, 57 of two types.

A first type of indentations 47 are interposed intermediate the grid points. The first type of indentations 47 extends both perpendicular to the planar surface 23 and parallel thereto, and thus—in the FIG. 1 embodiment—extends in a plane which is perpendicular to the planar surface 23. Thus, the first type of indentations 47 provides visual dividing lines between two juxtaposed modular parts.

The top panel 46 of the block element 40 extends in a distance ⅓ of a second standard module size in a direction perpendicular to the planar surface 23. The top panel 46 is visually divided from the first modular part by indentations 57 of a second type, which are arranged parallel to the planar surface 23 in a distance corresponding to one or more second standard module sizes from the planar surface 23 (in FIG. 1 the indentations 57 of the second type are arranged one second standard module size from the planar surface 23). As mentioned, thus the indentations 57 of the second type defines a visual dividing line between the top panel 46 and the first modular part 48. Thereby, the block element 40 visually appears as if it is finished off by a cover plate, despite the fact that it may be formed by a single integrated structure.

In the embodiment shown in FIG. 1, the block element 40 extends horizontally in a plane parallel to the planar surface 23, in a distance having a size equivalent to 5 standard module sizes. In the vertical direction the block element 40 extends respectively one and two standard modules. In the direction perpendicular to the planar surface 23 the block element 40 including the top panel 46 on the first modular part 48—extends a distance equivalent to 1⅓ (one and one third) second standard module sizes of a (standard) module.

The indentations 57 of the second type (or top panel indentation 57) divides the block element 40 into the first modular part 48 and the top panel 46, at least visually.

The indentations 47, 57 give the illusion that the block element is constructed by construction elements, such as modular construction elements.

Figure 2:
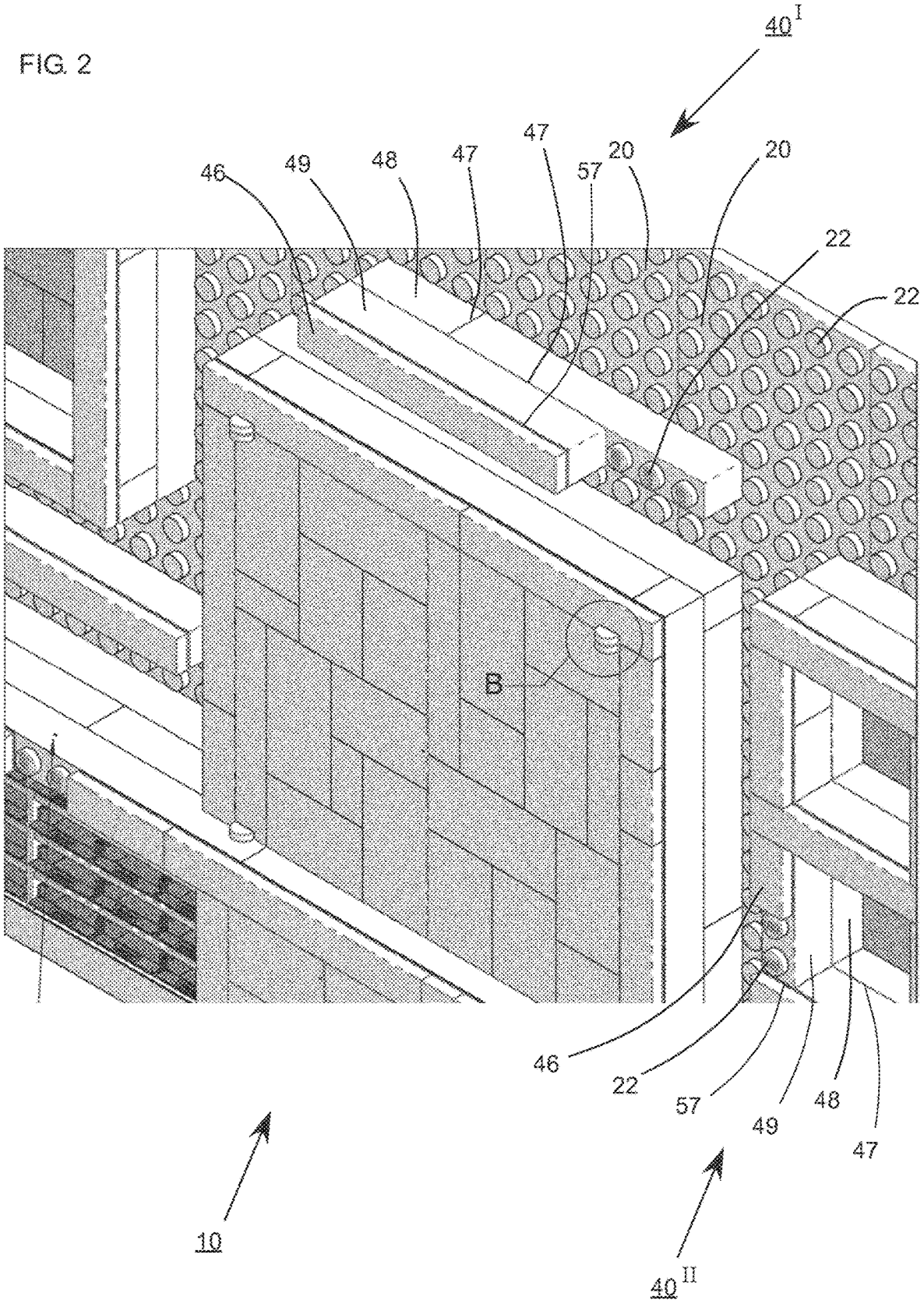
FIG. 2 illustrates a three dimensional view of a shelving system.

FIG. 2 illustrates a part of a shelving system 10 viewed in perspective (a three dimensional view). The shelving system 10 of FIG. 2 is a part of a shelving system 10 shown in FIG. 4 in a front view.

In the top part of FIG. 2, a shelf formed by a block element $\mathbf{40}^{I}$ having a depth/size/dimension of 2⅓ (two and one third) second stand module sizes, is illustrated.

The block element $\mathbf{40}^{I}$ comprises a spatial structure, the spatial structure comprising a first modular part 48, a second modular part 49, and a top panel 46. The first modular part 48 and second modular part 49 are visually divided by indentations 47 of the first type. In this case the indentation of the first type are arranged in a plane parallel to the planar surface 23, as was the indentations 57 of the second type described above in connection with FIG. 1.

The first modular part 48 extends—in the horizontal direction—11 first standard modular sizes. In the vertical direction, the first modular part 48 extends in one first standard modular size. In the direction perpendicular to the plane defined by the planar surface 23, the first modular part extends in one second standard modular size.

The second modular part 49 extends—in the horizontal direction—8 first standard modular sizes. In the vertical direction, the second modular part 49 extends in one first standard modular size. In the direction perpendicular to the plane defined by the planar surface 23, the second modular part extends in one second standard modular size.

The second modular part 49 and the top panel 46 are divided by the indentation 57 of the second type (see the description of FIG. 1, above). The indentation 57 of the second type extends on four surfaces of the spatial structure of the block element $\mathbf{40}^{I}$ in a plane parallel to the planar surface 23, in a distance from the planar surface 23 of two second standard module sizes.

The top panel 46 extends—in the horizontal direction—8 first standard modular sizes. In the vertical direction, the top panel 46 extends in one first standard modular size. In the direction perpendicular to the plane defined by the planar surface 23, the top panel 46 extends in ⅓ (one third) second standard modular size.

The indentations 47, 57 of the first and second types again divide the block element $\mathbf{40}^{I}$ visually into modular parts.

Thus, the block element $\mathbf{40}^{I}$ shown in the top part of FIG. 2 gives the illusion that the block element $\mathbf{40}^{I}$ has been built from four modular parts. The apparent four modular parts defined by the indentations 47, 57 of the first and second types, provide a shelf suitable for display purpose.

The shelving/shelf in form of the block element $\mathbf{40}^{I}$ is formed following a set of geometrical constraints set by the grid points and the first and second standard module sizes.

The surface of the first modular part 48, where the first modular part 49 does not extend (in the horizontal direction), has thre protrusions 22.

In the bottom right part of FIG. 2 another block element $\mathbf{40}^{II}$ is illustrated. This block element $\mathbf{40}^{II}$ comprises a spatial structure shape like a rectangular shelving/shelf or frame. In the embodiment the shown, the rectangular shelving/shelf or frame is formed from to square shelving/shelves or frames stacked on top of each other.

Part of the block element $\mathbf{40}^{II}$ comprises a first modular part 48 and a second modular part 49. The first modular part 48 and second modular part 49 are visually divided by indentations 47 of the first type.

The second modular part 49 and a top panel 46 are divided by indentation 57 of the second type. The indentations 47, 57 divide the block element $\mathbf{40}^{II}$ visually into modular parts. The shelving system 10 is adapted to give the illusion that the shelving system has been modular constructed using enlarged toy construction system elements.

The outer surfaces of the block elements 40 extend in standard module sizes in three mutually perpendicular directions.

Figure 3:
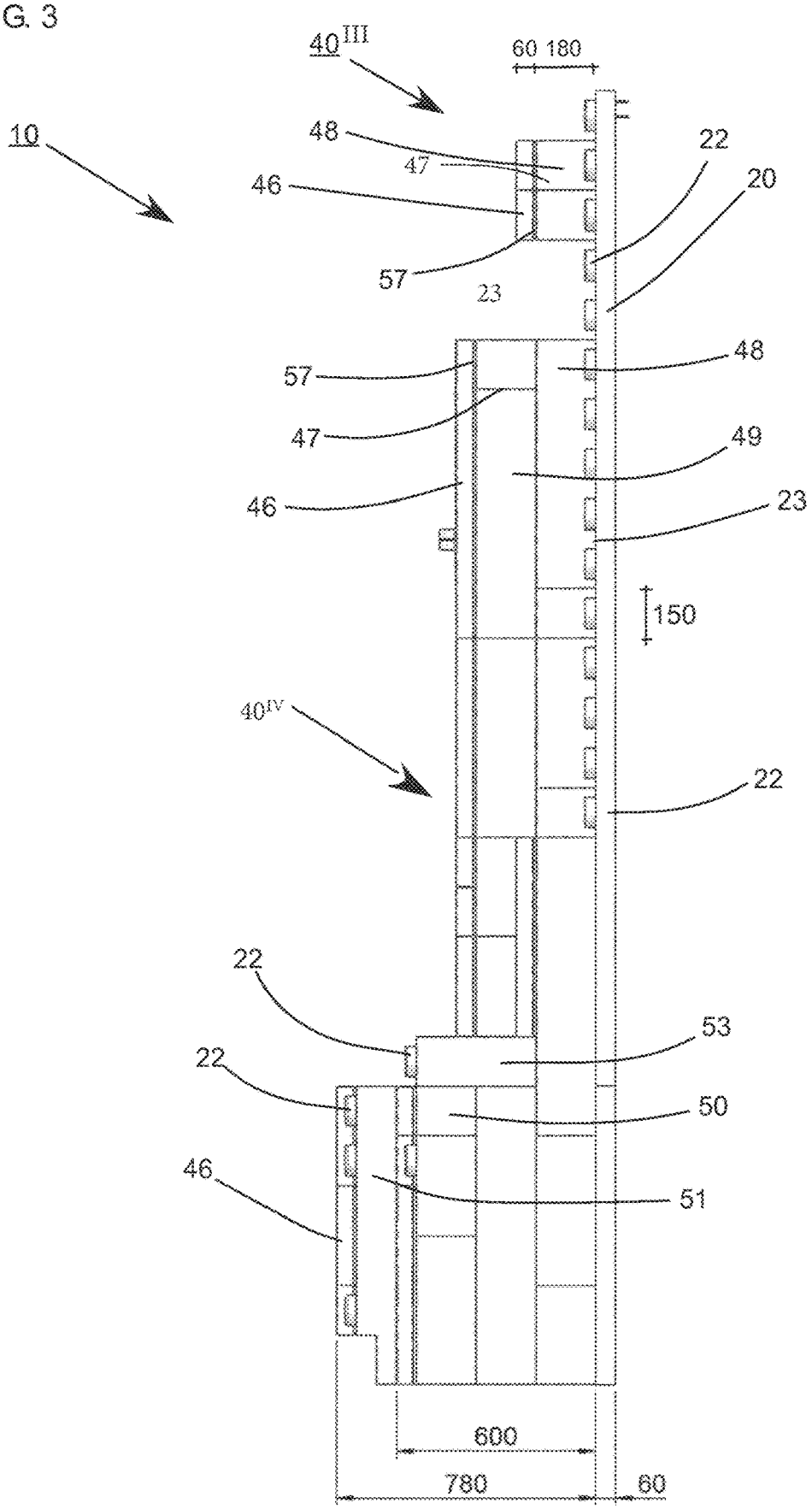
FIG. 3 illustrates a vertical cross sectional side view of a shelving system.
Figure 5:
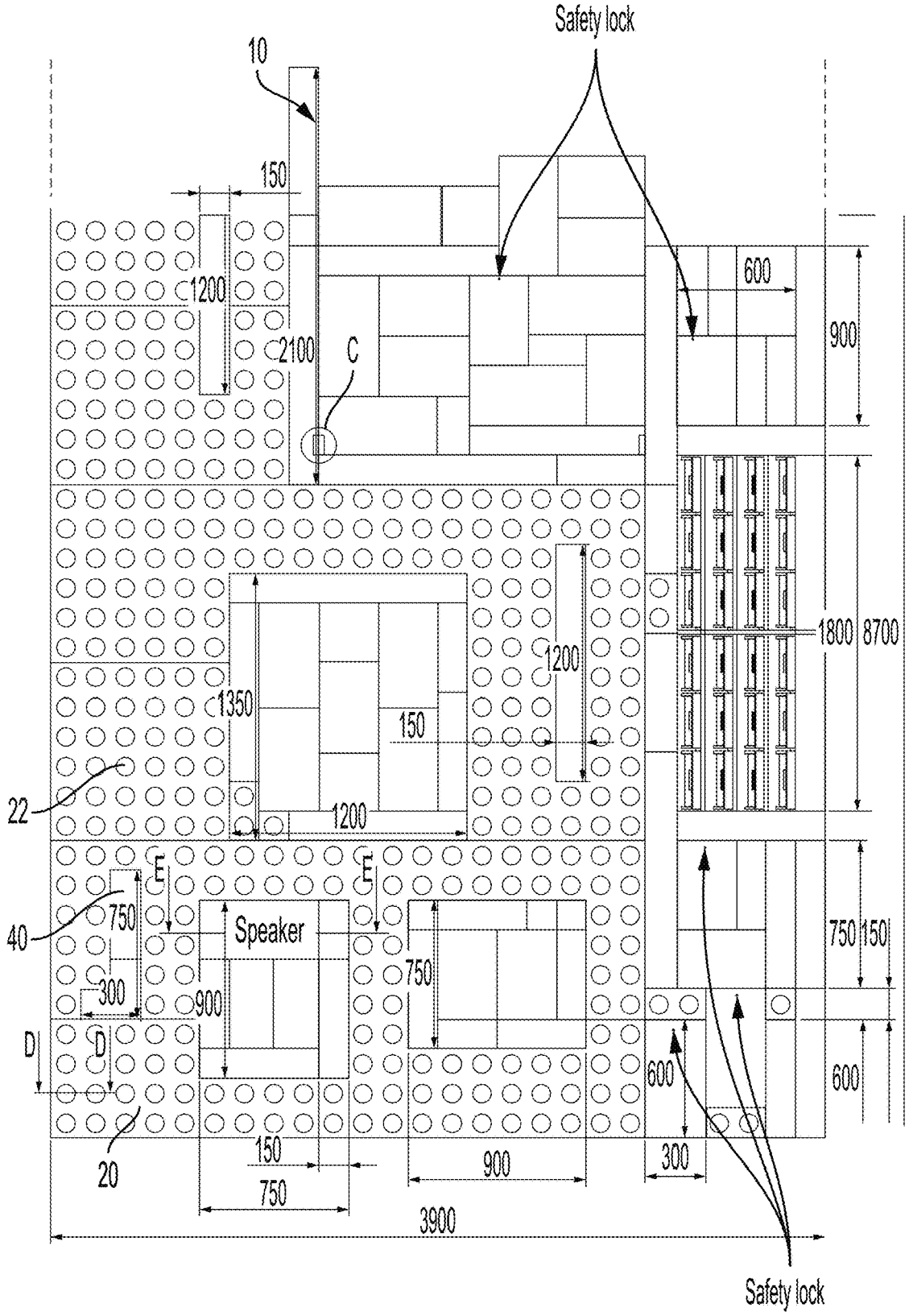
FIG. 5 shows a part of a front view of the shelving system shown in FIG. 3.

FIG. 3 is a side view of a vertical cross sectional view of a shelving system 10 shown in FIG. 5.

The shelving system 10 comprises a back panel 20, which comprises a planar surface 23, which comprises protrusions 22.

A number of block elements 40 of different sizes and shapes are formed on the back panel 20.

The block element $\mathbf{40}^{III}$, shown at the top of FIG. 3, comprises a first modular part 48 and a top panel 46. The second type of indentation 57 extends parallel with the planar surface 23 in a distance from the planar surface 23, corresponding to one second standard module size.

The lower part of the shelving system 10 comprises another block element $\mathbf{40}^{IV}$ comprising a first modular part 48 and a second modular part 49 arranged on (in front of) the first modular part 48. Additionally a third modular part 50 is arranged on (in front of) the second modular part 49. Furthermore a forth modular part 51 is arranged on (in front of) the third modular part 50. Each modular part 48, 49 50, 51 is arranged to extend a distance of one second standard module over an adjacent modular part.

In an upper portion of the lower block element $\mathbf{40}^{IV}$ of FIG. 3, the second modular part 49 arranged on the first modular part 48 is covered by a top flange 46. At a middle portion of the lower block element $\mathbf{40}^{IV}$ of FIG. 3, the first modular part 48 is covered by a top flange 46.

Each modular part is marked by indentations 47, both in a direction perpendicular and in parallel direction with respect to the planar surface 23. In general, the indentations 47 are interposed intermediate the grid points.

In a particular embodiment, the two dimensional grid points along the extent of the planar surface are positioned at a regular square grid, at a first standard module size of 150 mm. Thus the protrusions 22 are arranged at the grid points having a distance of 150 mm from centerline to centerline of the protrusions 22.

In this embodiment, the third dimension, perpendicular to the planar surface 23 comprises a second standard size of a module at 180 mm.

The back panel 20 and the top panel 46 comprise the width of 60 mm, in the direction perpendicular to the planar surface 23, being ⅓ of a second standard module size.

The indentations 47 may be positioned such that a modular part extends over several modules in all three directions defined by the three dimensional grid points. FIG. 3 also illustrates a modular part 53, which extends two second standard module sizes in the direction perpendicular to the planar surface 23.

Figure 4:
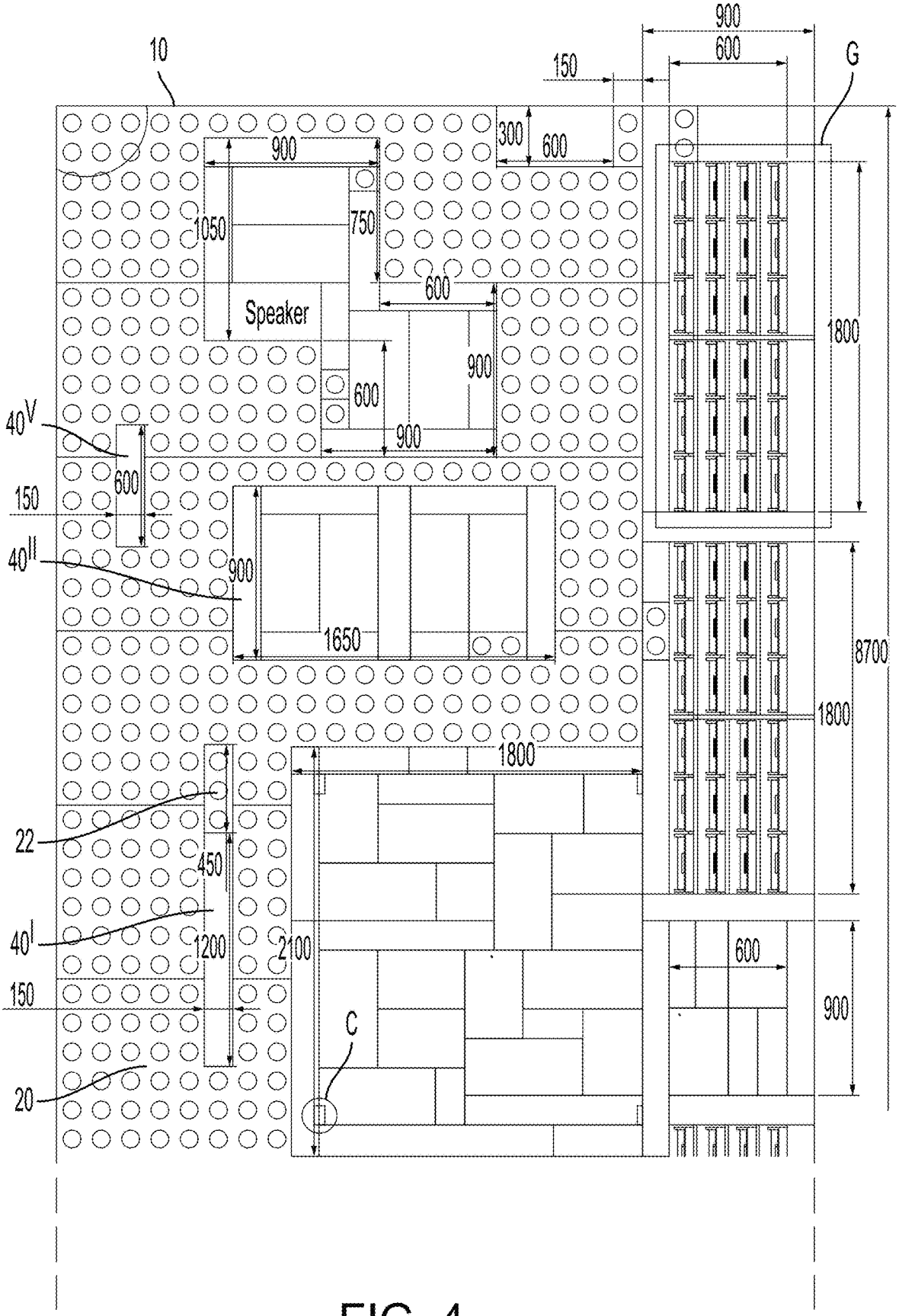
FIG. 4 shows a part of a front view of the shelving system shown in FIG. 3.

FIG. 4 in the uppermost portion of the shown shelving system 10, illustrates a further block element $\mathbf{40}^{V}$ comprising the sizes of 150×600 mm corresponding to a shelf extending 1×4 first standard module sizes.

Another block element 40$^{I}$ in the upper left portion of the shown shelving system 10, and described in connection with FIG. 2, comprises a second modular part 49, the size of 150×1200 mm, which forms a shelf comprising 1×8 first standard module sizes. The second modular part 49 is—as described in connection with FIG. 2—formed on a first modular part 48, with a size of 150×1650 mm, which forms a shelf comprising 1×11 first standard module sizes. The block element 40$^{I}$ comprises a combination of a top panel 46 on the second modular part 49, and three mutually identical cylindrical shaped protrusions 22, formed on the portion of the first modular part 48, which is not covered by the second modular part 49.

FIG. 5, in a front view, shows a shelving system 10, with different block elements than in FIG. 4. FIG. 5, at the top of the shelving system 10, for example illustrates an L-shaped block element 40, similar to the one shown in FIG. 1, comprising the size of 300×700 mm at one horizontal end, and having a width of one standard module at 150 mm at another horizontal end.

Figure 8:
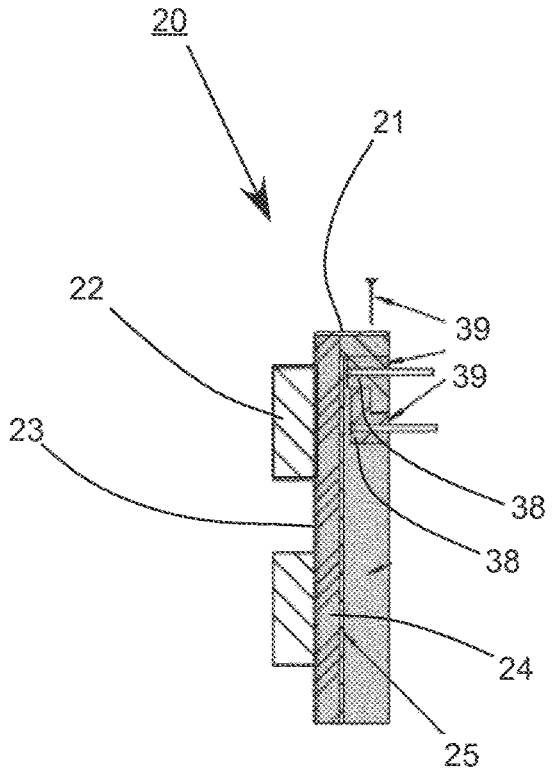
FIG. 8 illustrates a cross sectional side view of a back panel (view D, see FIG. 5)

The line marked D in FIG. 5 indicates a section of the back panel, which is shown in a side view in FIG. 8.

Figure 6:
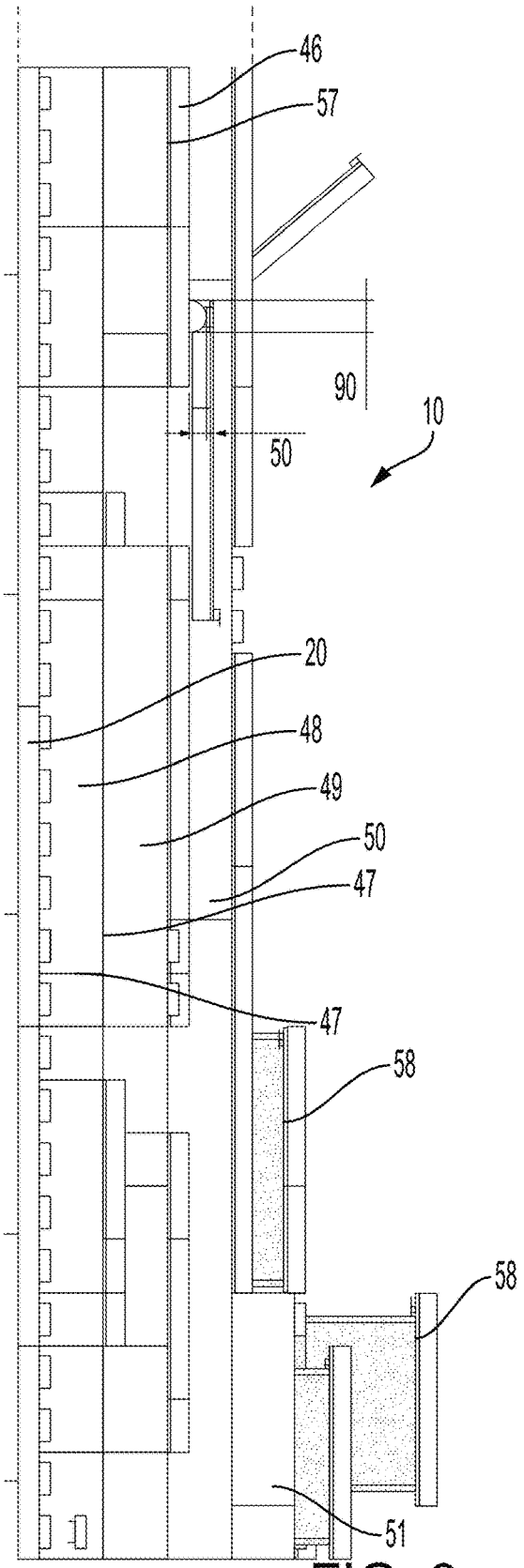
FIG. 6 shows a top view of a first part of the shelving system shown in FIGS. 3 and 5.

FIG. 6, in a top view, illustrates a left portion of a shelving system 10 as shown in FIG. 5. The shelving system 10 comprises a back panel 20 positioned adjacent a first modular part 48, a second modular part 49, a third modular part 50, and a fourth modular part 51.

The second modular part 49 is arranged on (in front of) the first modular part 48. The third modular part 50 is arranged on (in front of) the second modular part 49. The forth modular part 51 is arranged on (in front of) the third modular part 50. Each modular part 48, 49 50, 51 is arranged to extend a distance of one second standard module over an adjacent modular part. A top panel 46 is formed on some of the first, second, third or fourth modular parts.

The shelving system 10 comprises indentations 47, 57. The indentations mark the modular parts, the modular parts corresponding to the size of one or more standard modules. The modular parts are finished off by top panels 46 or protrusions 22, thus simulating that the shelving system has been constructed by toy construction elements.

All grids point on the front surfaces of the shelving system, which extend parallel with the planar surface 23 comprising either identically shaped protrusions 22 or top panels 46.

Figure 7:
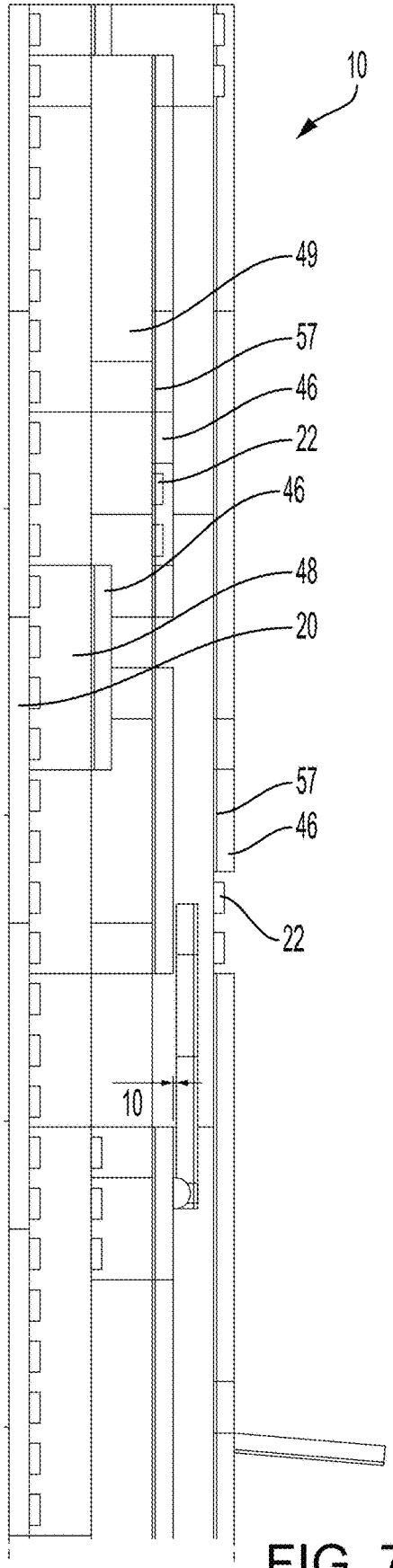
FIG. 7 shows a top view of a second part of the shelving system shown in FIGS. 3 and 4.

The shelving system 10 in FIGS. 6 and 07 further comprises drawers 58.

FIG. 7 illustrates the rest of the shelving system 10 shown in the FIG. 5 seen in a top view, i.e. FIG. 7 shows the right portion of the shelving system 10.

The outer measurements of a block element 40 are equal to a first or second standard module size of a module or larger. By larger is meant a multiple of the first or second standard module sizes. When a block element 40, 40$^{I}$, 40$^{II}$, 40$^{III}$, 40$^{IV}$, 40$^{V}$ is larger than one first or second standard module size, the block may comprise indentation 47, 57 to give the illusion that the block element 40, 40$^{I}$, 40$^{II}$, 40$^{III}$, 40$^{IV}$, 40$^{V}$, and the shelving system are assembled by several construction elements.

FIG. 8 illustrates a cross sectional side view of the back panel 20 shown in FIG. 5, which is marked by a D in FIG. 5.

The back panel 20 comprises a support or base structure 24. The base structure is preferably made of wooden material, such as 18 mm plywood. The base structure 24 comprises a cladding 21 on the front face and the top face of the back panel 20, which may be made of/formed in plastic, such as Kerrock or Corion.

The base structure 24 of each of the one or more back panels 20 may further comprise an inner cladding 25. The inner cladding 25 is adapted for/configured for strengthening the one or more back panels 20 to avoid bending thereof.

The back panel 20 comprises fastening means in form of a L-shaped mounting. The L-shaped mounting 38 may hang on a complementary L-shaped support fastened to the wall by fastening means, such as screws.

The cladding 21 on the front face of the back panel 20 comprises protrusions 22.

Figure 9:
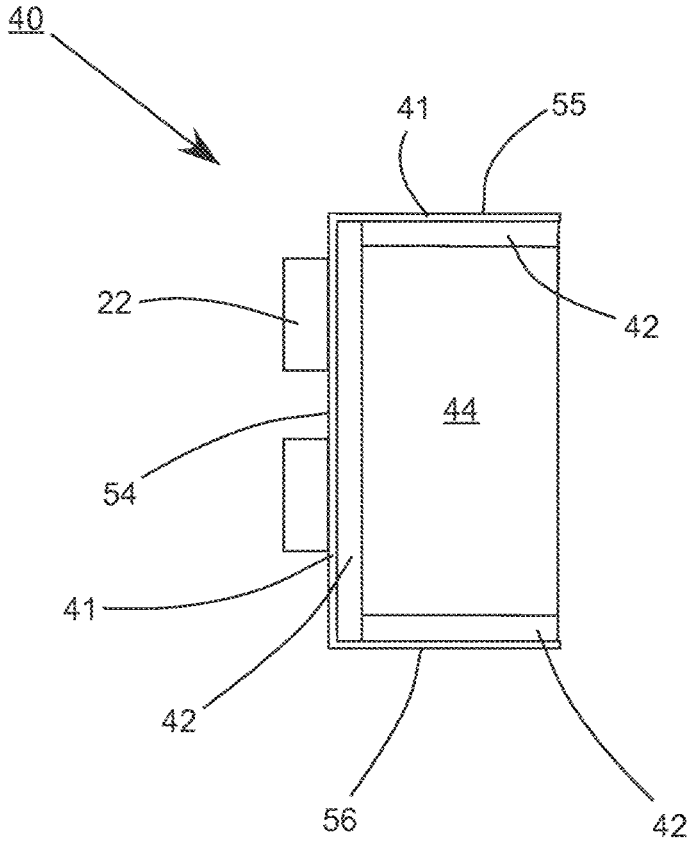
FIG. 9 illustrates a cross sectional side view of a block element.

The cross sectional side view of the block element shown in FIG. 9 has a similar structure.

The block element 40 comprises a support or base structure 42. The base structure is preferably made of wooden material. The base structure 42 comprises a cladding made of plastic, such as Kerrock or Corion, on a front face 54, on a top face 55 and on a bottom face 56, thus enclosing base structure 42 of the block element.

The block element 40, 40$^{I}$, 40$^{II}$, 40$^{III}$, 40$^{IV}$, 40$^{V}$ comprises an inner cavity 44. The inner cavity 44 has an inner face. The inner face of the inner cavity 44 comprises a shape complementary to an outer surface of the protruding flange(s) (37) of the block base 30. Thereby, the block bases 30 and the block elements 40 are thus configured to allow the block elements 40 to be mounted on and enclosing the one or more block bases 30.

The front of the block elements 40, 40$^{I}$, 40$^{II}$, 40$^{III}$, 40$^{IV}$, 40$^{V}$ comprises a planar front face 54 and comprises protrusions 22 shaped as toy construction elements comprising coupling organs. The coupling organs are positioned in the same two dimensional pattern defined by grid points of the planar surface 23 of the back panel 20.

The invention claimed is:

1. A shelving system comprising:

at least one back panel defining a planar surface, the at least one back panel comprising circular projections positioned on the planar surface in grid points of a two dimensional grid;

at least one block base coupled to the back panel and devoid of any circular projections, the at least one block base having a plurality of upstanding block base support walls forming a foundation with an internal cavity; and at least one block element defining a plurality of block element side walls forming a cover, the block element side walls aligned complementary to an alignment of the upstanding block base support walls such that the block element side walls are configured to snugly enclose the upstanding block base support walls within the cover, wherein:

the at least one block element extends a distance corresponding to a multiple of a standard module size in a plane parallel to the planar surface of the at least one back panel in two mutually perpendicular directions defined by the grid points of the two dimensional grid, and the at least one back panel is configured to mount vertically such that a portion of the plurality of block element side walls serve as shelving space.

2. A shelving system according to claim 1, wherein the at least one block element extends in a direction perpendicular to the planar surface of the at least one back panel in a distance corresponding to a multiple of a standard module size, the standard module sizes being defined by a distance between grid points of a three dimensional grid.

3. A shelving system according to claim 1, wherein outer surfaces of the at least one block element extend in one or more standard module sizes in three mutually perpendicular directions.

4. A shelving system according to claim 1, wherein the circular projections define a cylindrical shape.

5. A shelving system according to claim 1, wherein the outer surface of the at least one block element comprises a cladding formed in plastic.

6. A shelving system according to claim 5, wherein the cladding comprises one or more indentations, the indentations adapted to divide the at least one block element visually into modular parts in all three mutually perpendicular directions, such that each modular part is fully or partly outlined by indentations in a direction perpendicular to the planar surface and in a direction parallel to the planar surface, the indentations are interposed intermediate the grid points of the grids.

7. A shelving system according to claim 1, wherein the circular projections are positioned in the grid points of the two-dimensional grid, the circular projections define comprising a cylindrical shape, and extending in a direction perpendicular to the planar surface of the at least one back panel.

8. A shelving system according to claim 1, wherein the at least one block element comprises a top panel, the top panel extending a distance of ⅓ of a standard module in the direction perpendicular to the planar surface, the top panel being marked by one or more indentations, the one or more indentations extending parallel to the planar surface a distance from the planar surface corresponding to one or more standard module sizes.

9. A shelving system according to claim 1, wherein the at least one back panel comprises a base structure, the base structure being covered by an inner cladding.

10. A shelving system according to claim 1, wherein the at least one block base includes a protruding flange extending perpendicular from the at least one back panel.

11. A shelving system comprising:

a toy connector panel configured for vertical mounting and having circular projections on a planar surface thereof, the circular projections positioned on the planar surface in grid points of a two dimensional grid;

a block base affixed to the toy connector panel on the planar surface and lacking any circular projections, the block base defining foundation sidewalls extending perpendicular to the planar surface and aligned to form an internal cavity; and a block cover defining cover sidewalls and a cover surface connecting the cover sidewalls, the cover sidewalls and surface aligned to compliment and enclose the foundation sidewalls and thus the internal cavity, the cover sidewalls configured to provide vertical support, the block cover extending a distance corresponding to a multiple of a standard module size in a plane parallel to the planar surface of the toy connector panel in two mutually perpendicular directions defined by the grid points of the two dimensional grid.

12. A shelving system according to claim 11, wherein the block cover has a dimension corresponding to a multiple of a standard module size, the standard module size being defined by a distance between grid points of a three dimensional grid.

13. A shelving system according to claim 11, wherein the block base has a dimension corresponding to a multiple of a standard module size, the standard module size being defined by a distance between grid points of a three dimensional grid.

14. A shelving system according to claim 11, wherein an outer surface of the block cover comprises a cladding formed in plastic.

15. A shelving system comprising:

a toy connector panel configured to mount vertically, the toy connector panel defining a planar surface having circular projections positioned in grid points of a two dimensional grid;

a block foundation formed by sidewalls defining an internal cavity, the block foundation affixed to the toy connector panel and lacking any circular projections but extending in a same direction as the circular projections of the toy connector panel; and a block cover configured to mount to and encapsulate the block foundation, the block cover configured to vertically support modular parts mounted adjacent and above the block cover on the toy connector panel, the block cover extending a distance corresponding to a multiple of a standard module size in a plane parallel to the planar surface of the toy connector panel in two mutually perpendicular directions defined by the grid points of the two dimensional grid.

16. A shelving system according to claim 15, wherein the block cover extends in a direction perpendicular to the planar surface of the toy connector panel.

17. A shelving system according to claim 15, wherein the block cover has a dimension corresponding to a multiple of a standard module size, the standard module size being defined by a distance between grid points of a three dimensional grid.

18. A shelving system according to claim 15, wherein the block foundation has a dimension corresponding to a multiple of a standard module size, the standard module size being defined by a distance between grid points of a three dimensional grid.

19. A shelving system according to claim 15, wherein an outer surface of the block cover comprises a cladding formed in plastic.

* * * * *